US008444754B2

(12) United States Patent
June et al.

(10) Patent No.: US 8,444,754 B2
(45) Date of Patent: May 21, 2013

(54) ELECTROSTATIC CONTROL OF AIR FLOW TO THE INLET OPENING OF AN AXIAL FAN

(75) Inventors: Michael S. June, Raleigh, NC (US); Chunjian Ni, Durham, NC (US); Mark E. Steinke, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 304 days.

(21) Appl. No.: 12/855,737

(22) Filed: Aug. 13, 2010

(65) Prior Publication Data

US 2012/0036998 A1 Feb. 16, 2012

(51) Int. Cl.

| | |
|---|---|
| ***B03C 3/36*** | (2006.01) |
| ***B03C 3/41*** | (2006.01) |
| ***B03C 3/49*** | (2006.01) |

(52) U.S. Cl.

USPC ..... 96/63; 55/385.6; 55/DIG. 38; 95/78; 96/96

(58) Field of Classification Search

USPC ..... 96/63, 96, 98; 55/385.6, DIG. 38; 95/78; 361/225–235

See application file for complete search history.

(56) References Cited

U.S. PATENT DOCUMENTS

| | | | | |
|---|---|---|---|---|
| 4,202,674 | A * | 5/1980 | Rodenberger et al. | 96/63 |
| 4,496,375 | A | 1/1985 | LeVantine | |
| 4,919,693 | A | 4/1990 | Olney | |
| 5,277,703 | A * | 1/1994 | Sklenak et al. | 95/77 |
| 5,980,614 | A * | 11/1999 | Loreth et al. | 96/63 |
| 5,993,738 | A | 11/1999 | Goswani | |
| 6,017,381 | A * | 1/2000 | Dunn et al. | 95/3 |
| 6,118,645 | A | 9/2000 | Partridge | |
| 6,322,614 | B1 * | 11/2001 | Tillmans | 96/16 |
| 6,497,753 | B1 * | 12/2002 | Gutmann | 96/55 |
| 6,785,114 | B2 | 8/2004 | Gorczyca et al. | |
| 6,951,582 | B1 | 10/2005 | Tsai et al. | |
| 7,054,130 | B2 | 5/2006 | Gorczyca et al. | |
| 7,295,418 | B2 | 11/2007 | Vernitsky et al. | |
| 7,368,003 | B2 | 5/2008 | Crapser et al. | |
| 7,585,344 | B2 | 9/2009 | Paterson et al. | |
| 2001/0020417 | A1 * | 9/2001 | Liu et al. | 96/66 |
| 2001/0029842 | A1 * | 10/2001 | Hoenig | 96/63 |
| 2003/0218855 | A1 | 11/2003 | Goldenberg | |
| 2009/0056550 | A1 | 3/2009 | Chung | |
| 2010/0015907 | A1 | 1/2010 | Paterson et al. | |
| 2010/0052329 | A1 | 3/2010 | Lazar | |

FOREIGN PATENT DOCUMENTS

| | | | | |
|---|---|---|---|---|
| GB | 2016305 A * | 9/1979 | | 96/96 |

* cited by examiner

*Primary Examiner* — Richard L Chiesa

(74) *Attorney, Agent, or Firm* — Cynthia G. Seal; Jeffrey L. Streets

(57) ABSTRACT

An air moving apparatus includes an axial fan and an electrostatic device. The axial fan has a rotatable shaft defining a central axis of the axial fan, a plurality of blades secured to the shaft, and an air inlet opening. The electrostatic device is disposed immediately upstream of the air inlet opening of the axial fan, and includes a collector and an emitter. In one embodiment, the electrostatic device includes a cylindrical collector coupled to ground and has a central axis aligned with the central axis of the axial fan. The electrostatic device further includes a plurality of emitter wires coupled to a terminal of a direct current source and extending lengthwise within the cylindrical collector. During operation of the axial fan, the application of an electrical potential between an emitter and a collector causes ionic air movement radially outwardly away from a central axis of the axial fan.

11 Claims, 5 Drawing Sheets

ELECTROSTATIC CONTROL OF AIR FLOW TO THE INLET OPENING OF AN AXIAL FAN

BACKGROUND

1. Field of the Invention

The present invention relates to improving the performance and efficiency of an axial fan.

2. Background of the Related Art

Computer systems include numerous components that use electrical energy and produce heat as a byproduct. Typically, these components are organized in a chassis for efficient placement, storage and operation. The heat produced by the components within a chassis may be removed by forcing cool air into the chassis, across the components and then out of the chassis. This forced air circulation may be done with one or more air moving device positioned within the chassis or external to the chassis.

An axial fan is a common type of air moving device that is used in many applications, including forced air cooling in a computer chassis. An axial fan, or axial-flow fan, has blades that force air to move parallel to a central shaft about which the blades rotate. Depending upon the chassis dimensions and the air flow requirements of the components within the chassis, a fan assembly may include multiple fans.

An axial fan may operate at various speeds as determined by a fan controller, for example to maintain component temperatures below a setpoint temperature. Because component cooling requirements may change over time with varying workload, a fan controller may frequently adjust the fan speed. While it is important to keep component temperatures from reaching levels that can damage the components, it is also important to conserve electrical power to the fans and avoid using unnecessarily high fan speeds.

The design of the fan may play a significant role in the operating efficiency of the fan. For example, a first fan may be optimized for performance so that it can operate over a wide range of air flow rates, while a second fan may be optimized for electrical efficiency over a much narrower range of air flow rates. The best choice of a fan for a given system chassis may change over time in response to the current operating conditions of the components within the chassis.

BRIEF SUMMARY

One embodiment of the present invention provides an air moving apparatus, comprising an axial fan and an electrostatic device. The axial fan has a rotatable shaft defining a central axis of the axial fan, a plurality of blades secured to the shaft, and an air inlet opening. The electrostatic device is disposed immediately upstream of the air inlet opening of the axial fan, and includes a collector and an emitter. In one embodiment, the electrostatic device comprises a cylindrical collector coupled to ground and has a central axis aligned with the central axis of the axial fan, wherein the cylindrical collector has an inner diameter that is substantially the same as the diameter of an air inlet opening to the axial fan. The electrostatic device of this embodiment further comprises a plurality of emitter wires extending lengthwise within the cylindrical collector. The emitter wires are coupled to either a positive terminal of a direct current (DC) source to form a positive corona or a negative terminal of a direct current source to form a negative corona.

Another embodiment of the present invention provides a method of modifying the airflow to the inlet of an axial fan. The method comprises operating an axial fan to move air longitudinally through an air inlet opening of the axial fan, and, during operation of the axial fan, applying an electrical potential between an emitter and a collector to cause ionic air movement radially outwardly away from a central axis of the axial fan, wherein the radially outward air movement is caused upstream of the axial fan before the air reaches the air inlet opening.

DETAILED DESCRIPTION

Figure 1:
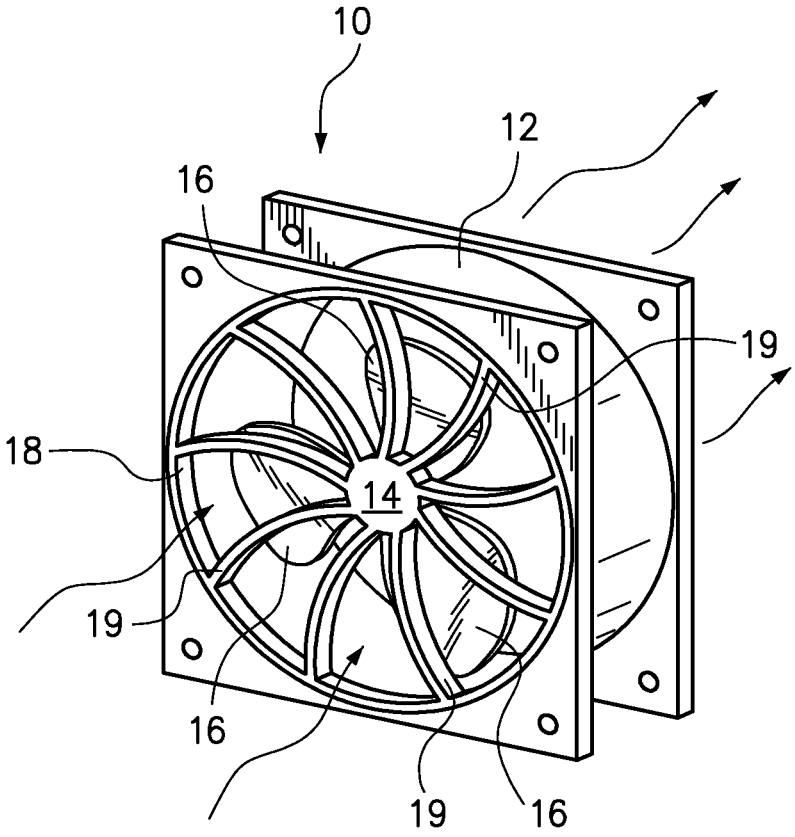
FIG. 1 (PRIOR ART)
FIG. 1 is a perspective view of a prior art axial fan.

One embodiment of the present invention provides an air moving apparatus, comprising an axial fan and an electrostatic device. The axial fan has a rotatable shaft defining a central axis of the axial fan, a plurality of blades secured to the shaft, and an air inlet opening. The electrostatic device is disposed immediately upstream of the air inlet opening of the axial fan, and includes a collector and an emitter. In one embodiment, the electrostatic device comprises a cylindrical collector coupled to ground and has a central axis aligned with the central axis of the axial fan, wherein the cylindrical collector has an inner diameter that is substantially the same as the diameter of an air inlet opening to the axial fan. The electrostatic device of this embodiment further comprises a plurality of emitter wires coupled to a positive or negative terminal of the direct current source and extending lengthwise within the cylindrical collector. The collector and emitter may be made from any conductive material, which is most preferably a conductive metal.

Embodiments of the invention may include various configurations of the plurality of emitter wires. For example, the plurality of emitter wires may be parallel to the central axis of the cylindrical collector, or diverge along their length toward the air inlet opening of the axial fan. Whether the emitter wires are parallel or divergent, each emitter wire is preferably equidistant from the central axis of the cylindrical collector as each other emitter wire. It is preferable that each emitter wire is no further from the central axis than the radius of the shaft, because the emitter wires will not physically interfere with the desired flow or air into the air inlet opening of the fan and the influence of electrostatic air movement reaches into the region directly in front of the shaft. In another configuration, the plurality of emitter wires is coupled by a conductive ring at each end. It should be recognized that one or more other foregoing aspects of the emitter wire configurations may be combined and used together in a single air moving device in accordance with the invention.

In another embodiment, the apparatus comprises electrical connectors in electronic communication with the collector and emitter to facilitate coupling to ground and a direct current source. Specifically, the apparatus may include a first electrical connector in electronic communication with the cylindrical collector and a second electrical connector in electronic communication with the plurality of emitter wires, wherein the first electrical connector is adapted for coupling to ground and the second electrical connector is adapted for coupling to either the positive or negative terminal of a direct current source. While each embodiment of the electrostatic device must provide for an electrical potential between the collector and emitter, the first and second electrical connectors facilitate installation of the electrostatic device.

In yet another embodiment, the apparatus further comprises a plurality of electrically insulative brackets secured between the cylindrical collector and some portion of the plurality of emitter wires, wherein the bracket secures the plurality of emitter wires in position within the cylindrical collector. For example, an electrically insulative bracket may be fabricated with plastic to be secured to an edge of the cylindrical collector and extend radially inwardly to secure a conductive ring that is itself directly coupled to the plurality of emitter wires. One or more of such brackets may be used at each end of the cylindrical collector to secure the emitter wires in a desired position. Other bracket configurations or structural elements may be suitable designed and used to position the emitter wires within the cylindrical collector.

In order for the electrostatic device to modify the condition of the air flow to the air inlet opening of the axial fan, the electrostatic device must be positioned directly in front of the air inlet opening. Although there are many ways to secure the electrostatic device in this position, one embodiment of the electrostatic device is secured to a housing of the axial fan. For example, tabs extending from the ESD may each include a hole for receiving a screw or bolt for securing to the front of the axial fan housing.

Another embodiment of the present invention provides a method of modifying the airflow to the inlet of an axial fan. The method comprises operating an axial fan to move air longitudinally through an air inlet opening of the axial fan, and, during operation of the axial fan, applying an electrical potential between an emitter and a collector in front of the air inlet opening to cause ionic air movement radially outwardly away from a central axis of the axial fan before the air reaches the air inlet opening. This method may be used with any of the foregoing electrostatic device configurations disclosed herein.

The various apparatus and methods of the invention may be used to shape the inlet velocity profile of the fan. It should be understood that the ESD configurations are not intended to generate any longitudinal airflow. Rather, the invention recognizes that the inlet air flow to the impeller of an axial fan affects its performance. In the absence of the present ESD, the inlet air flow to an axial fan will concentrate in the center/hub region, while the fan blade tips are starved for air. This poor inlet flow condition will hurt the performance of the fan, i.e., either the air flow is reduced, or the fan will consume more power to achieve a desired air flow rate. The ESDs disclosed herein, improve the performance and energy efficiency of an axial fan by modifying and improving the inlet air flow condition to the front of the fan. Specifically, the ESD is configured and positioned to drive air in the center region to the annular region of the air inlet opening using radially directed ionic air flow. Thus, the incoming inlet flow of air to the axial fan will be re-directed toward the fan's blade tip region, thereby improving the inlet flow condition for the axial fan. An ESD may be made small enough to be positioned in front of an axial fan in most computer systems, including a space-constrained server chassis.

In a further embodiment, a high electric potential, such as 8000V DC or greater, is applied across the emitter and collector leading to ionization of air around the emitter wires. The ions are then attracted to the cylindrical collector and, in the process, transfer momentum to the adjacent air molecules resulting in airflow in a direction from the emitter to the collector. The ESD configurations disclosed in this application will produce ionic air movement that is substantially radial (with respect to a central axis of the ESD), while the axial fan produces air flow that is substantially longitudinal (i.e., parallel to the axis of the axial fan). It should be recognized that all references to upstream or downstream positions, or even references to the front or back of a fan, are made with reference to the airflow direction established by the axial fan. Although the electrical potential is preferably 8000V DC or greater, the power input to the ionic device may be less than 20 W with the proper optimization.

FIG. 1 is a perspective view of a prior art axial fan 10. The fan includes a housing 12, a rotatable shaft 14 that defines an axial center of the fan, and a plurality of blade 16 coupled to the shaft 14 for causing longitudinal air movement. A circular air inlet opening 18 allows air to pass into and through the front face of the fan housing 12 (See the wavy arrows indicating air flow). The fan 10 includes several elements 19 that secure the shaft 14 in position within the housing 12 with minimal air blockage or resistance.

Figure 2:
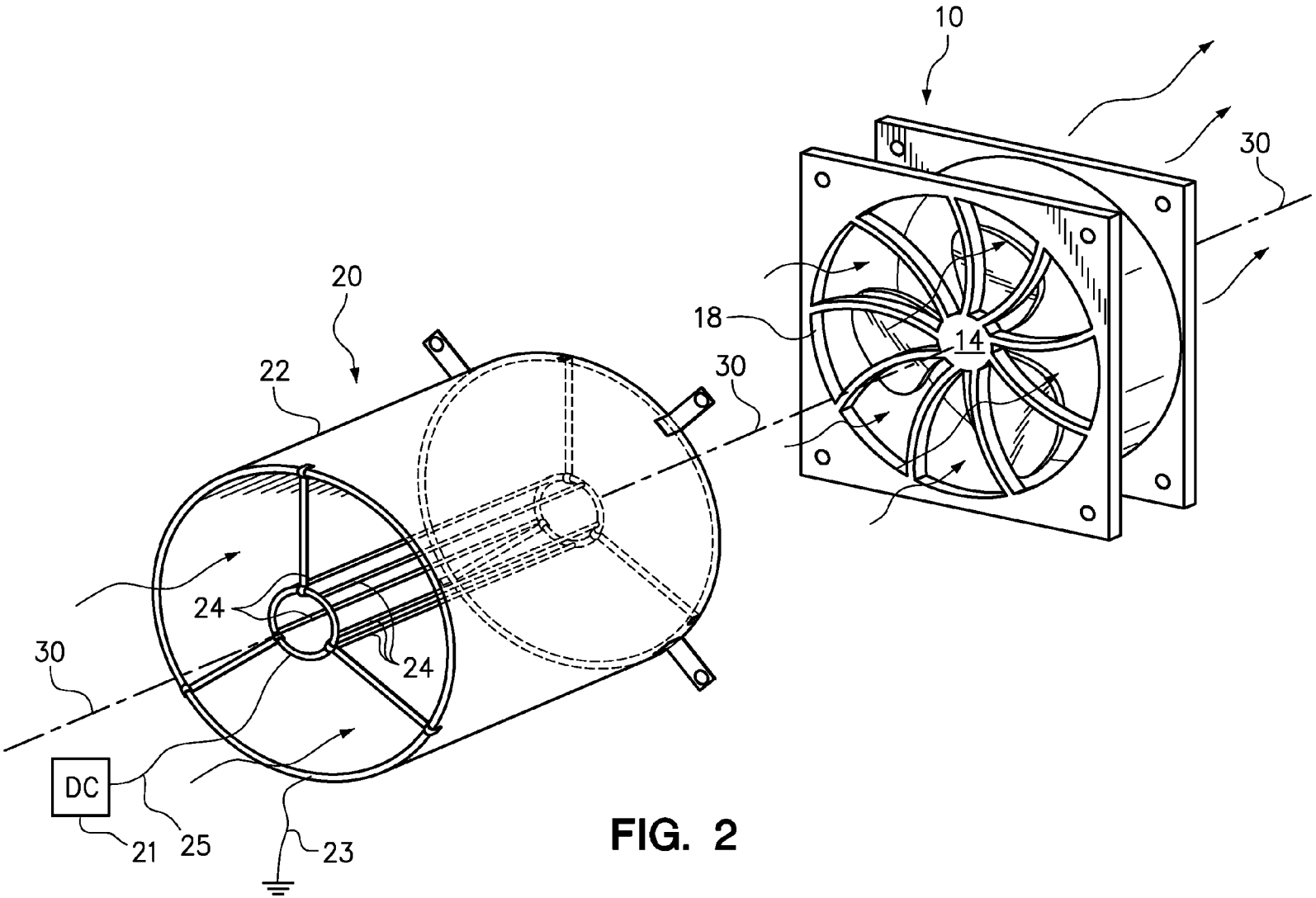
FIG. 2 is a perspective assembly view of a first embodiment of an electrostatic device (ESD) aligned with the inlet of the axial fan and configured to improve the performance of the axial fan.

FIG. 2 is a perspective assembly view of a first embodiment of an electrostatic device (ESD) 20 aligned with the air inlet opening 18 of the axial fan 10 and configured to improve the performance of the axial fan. The ESD 20 includes a cylindrical collector 22 and a plurality of emitter wires 24 secured within the collector 22. A collector lead wire 23 and emitter lead wire 25 are provided to facilitate electronic communication with ground and a negative or positive terminal a direct current source 21. The ESD 20 and the axial fan 10 are aligned on a common central axis 30.

Figure 3:
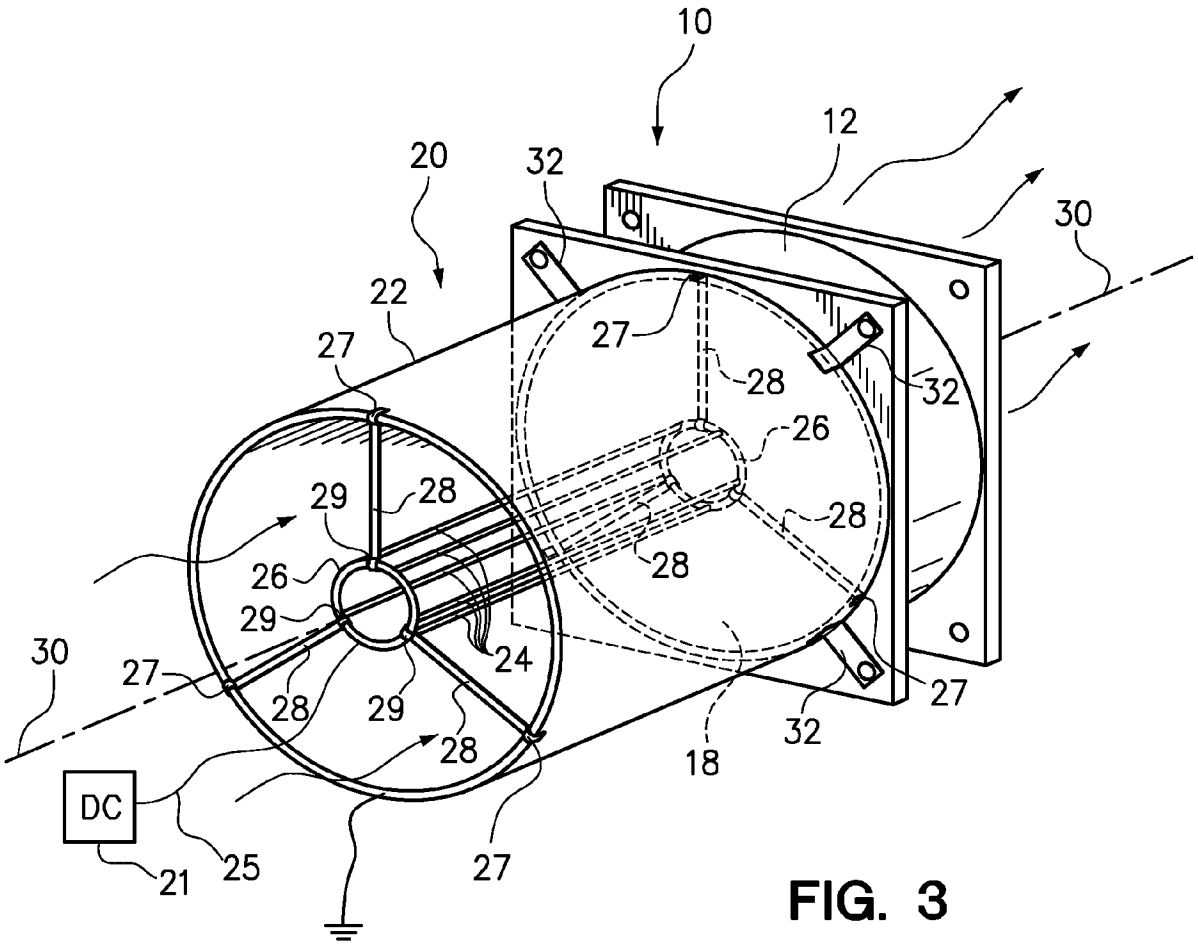
FIG. 3 is a perspective view of the first embodiment of the ESD in its operative position at the inlet of the axial fan.

FIG. 3 is a perspective view of the first embodiment of the ESD 20 in its operative position in front of the air inlet opening 18 of the axial fan 10. In fact, the ESD 20 has four tabs 32 (three shown) that receive screws to secure the ESD to the fan housing 12. The ESD 20 also has a plurality of emitter wires 24 coupled between a pair of conductive wire rings 26 near the opposing ends of the ESD 20. The emitter wire lead 25 is connected to the front ring, though the lead could be connected elsewhere on the emitter structure. The emitter wires 24 are substantially parallel and equi-angularly spaced about the rings 26. Five emitter wires 24 are shown, but the number of emitter wires may vary, such as between 3 and 8 emitter wires. Still, a fan with a much larger diameter would typically include a larger number of emitter wires.

A set of insulative (i.e., electrically nonconductive) brackets 28 secures the plurality of emitter wires 24 in a desired position, such as centered about the central axis 30 of the cylindrical collector 22. This position provides equal spacing between the inner surface of the cylindrical collector 22 and the individual emitter wires 24, and also places the emitter wires 24 directly in front of the axial fan shaft 14 (see FIGS. 1 and 2), which may include a forward facing hub. As shown, each bracket 28 may include a first end with a clip 27 for securing to the cylindrical collector 22 and a second end with a clip 29 for securing to one or more of the emitter wires 24 or the ring 26.

Figure 4:
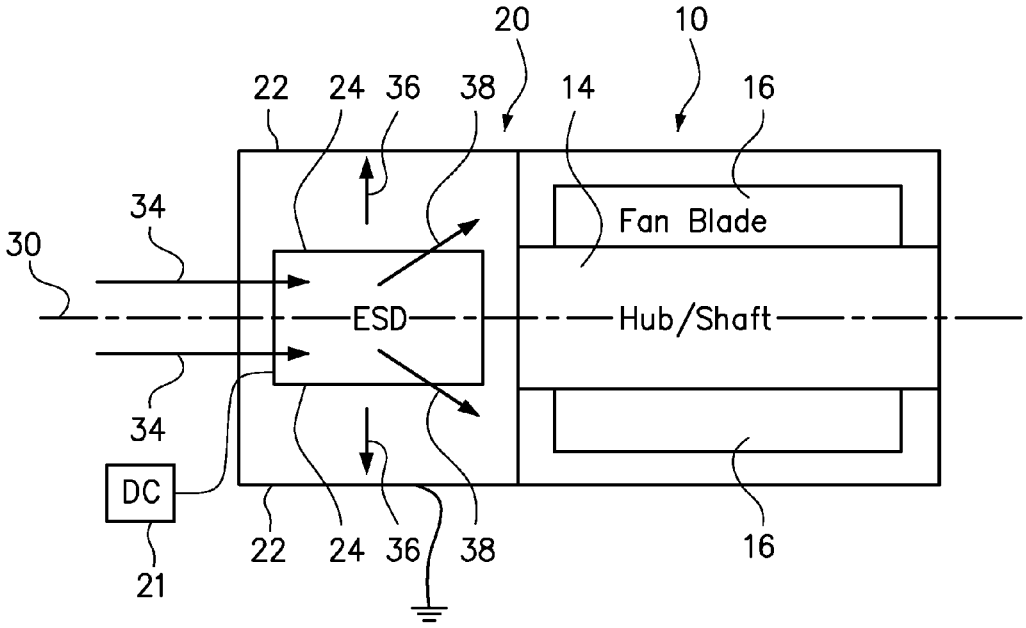
FIG. 4 is a schematic side view of the ESD and axial fan of FIG. 3 illustrating how the ESD improves the performance of the axial fan.

FIG. 4 is a schematic side view of the ESD 20 and axial fan 10 of FIG. 3 illustrating how the ESD improves the performance of the axial fan. While the axial fan 10 produces a longitudinal flow of air (see arrows 34), much of this air flow is concentrated in a central region near the central axis 30 that is aligned with the shaft 14. When the ESD 20 has an electrical potential applied between the collector 22 and the emitter 24, the ESD imparts substantially radial ionic air movement (see arrows 36). As air flows through the ESD 20, the influence of the substantially radial ionic air movement directs the air flow in the central region near the central axis 30 outwardly toward the center or tips of the blades 16. The net effect of the longitudinal air flow imparted by the fan 10 and the radial air flow imparted by the ESD 20 is illustrated by angled arrows 38.

Figure 5:
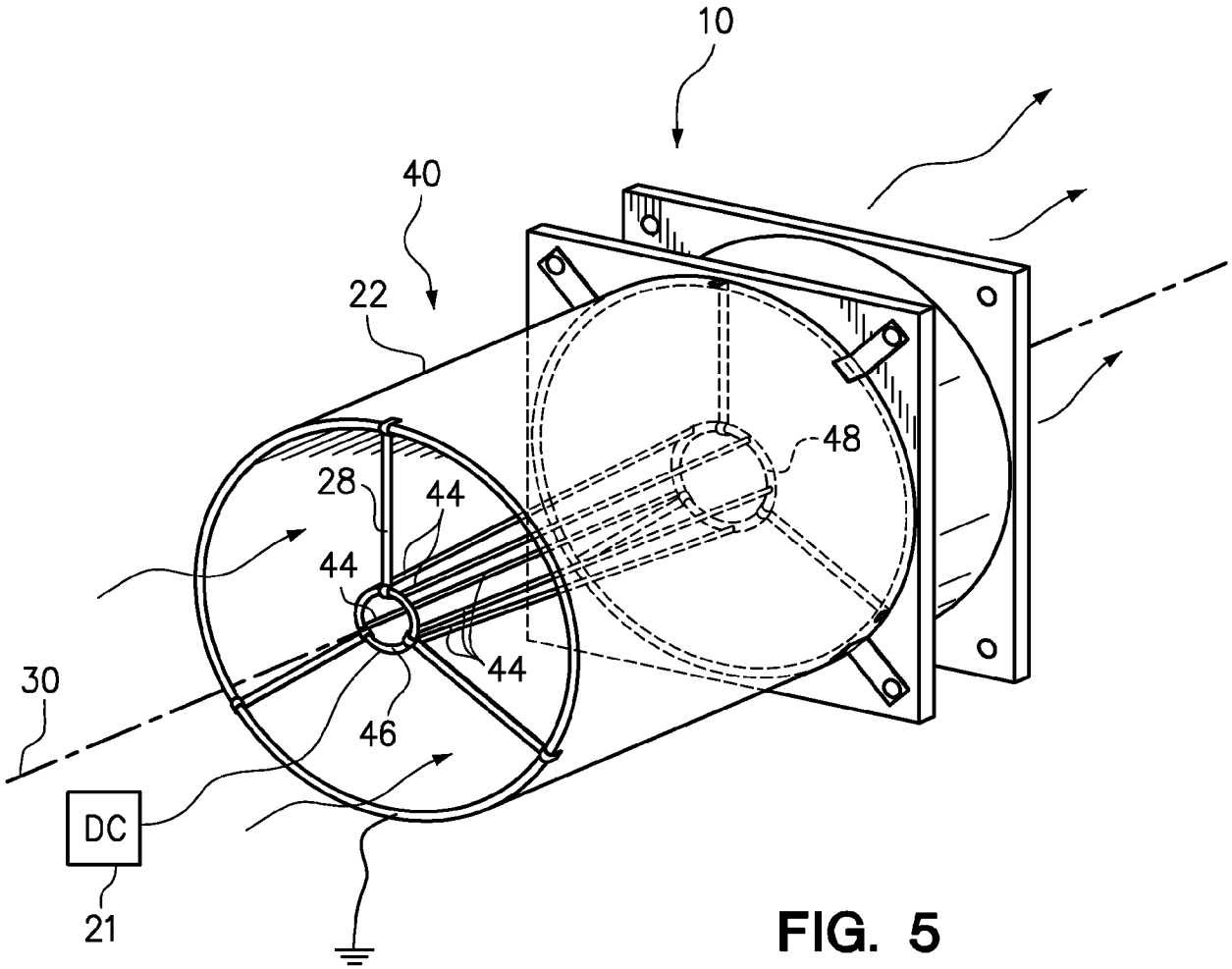
FIG. 5 is a perspective view of a second embodiment of an ESD in its operative position at the inlet of the axial fan.

FIG. 5 is a perspective view of a second embodiment of an ESD 40 in its operative position at the air inlet opening of the axial fan 10. The ESD 40 is substantially the same as the ESD 20 of FIGS. 2 and 3, except that the plurality of emitter wires 44 are divergent, to form a cone-like configuration as opposed to the cylinder-like configuration of the emitter wires in FIGS. 2 and 3. Accordingly, a first conductive ring 46 at the front end of the emitter wires has a smaller diameter than a second conductive ring 48 at the back end of the emitter wires. The smaller conductive ring 46 moves the upstream portion of the emitter wires 44 inwardly in order to exert an initial ionic influence on the airflow closer to the central axis 30. Other components of the ESD 40 are similar to those of the ESD 20 in FIGS. 2 and 3.

Figure 6:
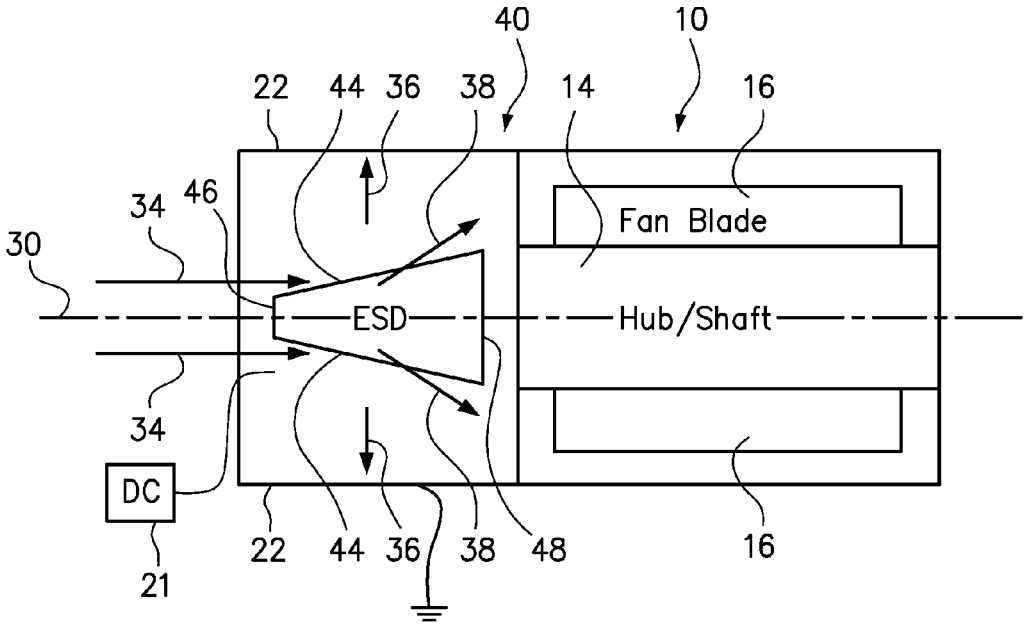
FIG. 6 is a schematic side view of the ESD and axial fan of FIG. 5 illustrating how the ESD improves the performance of the axial fan.

FIG. 6 is a schematic side view of the ESD 40 and axial fan 10 of FIG. 5 illustrating how the ESD improves the performance of the axial fan. While the axial fan 10 produces a longitudinal flow of air (see arrows 34), much of this air flow is concentrated in a central region near the central axis 30 that is aligned with the shaft 14. When the ESD 40 has an electrical potential applied between the cylindrical collector 22 and the emitter wires 24, the ESD imparts substantially radial ionic air movement (see arrows 36). As air flows through the ESD 40, the influence of the substantially radial ionic air movement directs the air flow in the central region near the central axis 30 outwardly toward the center or tips of the blades 16. The net effect of the longitudinal air flow imparted by the fan 10 and the radial air flow imparted by the ESD 40 is illustrated by angled arrows 38.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An air moving apparatus, comprising:

an axial fan having a rotatable shaft defining a central axis of the axial fan, a plurality of blades secured to the shaft, and an air inlet opening; and an electrostatic device disposed immediately upstream of the air inlet opening of the axial fan, the electrostatic device comprising:

a cylindrical collector coupled to ground and having a central axis aligned with the central axis of the axial fan, wherein the cylindrical collector has an inner diameter that is substantially the same as the diameter of an air inlet opening to the axial fan; and a plurality of emitter wires coupled to a terminal of a direct current source and extending lengthwise within the cylindrical collector.

2. The apparatus of claim 1, wherein the plurality of emitter wires are coupled by a conductive ring at each end.

3. The apparatus of claim 1, further comprising:

a first electrical connector in electronic communication with the cylindrical collector, wherein the first electrical connector is adapted for coupling to ground; and a second electrical connector in electronic communication with the plurality of emitter wires, wherein the second electrical connector is adapted for coupling to the terminal of the direct current source.

4. The apparatus of claim 1, wherein the plurality of emitter wires are parallel to the central axis of the cylindrical collector.

5. The apparatus of claim 4, wherein each emitter wire is equidistant from the central axis of the cylindrical collector.

6. The apparatus of claim 1, wherein the plurality of emitter wires diverge along their length toward the air inlet opening of the axial fan.

7. The apparatus of claim 1, further comprising:

a plurality of electrically insulative brackets secured between the cylindrical collector and some portion of the plurality of emitter wires, wherein the bracket secures the plurality of emitter wires in position within the cylindrical collector.

8. The apparatus of claim 1, wherein the electrostatic device is secured to a housing of the axial fan.

9. The apparatus of claim 1, wherein each emitter wire is no further from the central axis than the radius of the shaft.

10. The apparatus of claim 1, wherein the plurality of emitter wires are coupled to a positive terminal of the direct current source to form a positive corona.

11. The apparatus of claim 1, wherein the plurality of emitter wires are coupled to a negative terminal of the direct current source to form a negative corona.

* * * * *